US006206075B1

(12) United States Patent
Prince et al.

(10) Patent No.: US 6,206,075 B1
(45) Date of Patent: Mar. 27, 2001

(54) CELLULAR WINDOW COVERING HAVING SEAMLESS CELLS AND METHOD FOR MAKING SAME

(75) Inventors: Kendall Prince, Mesa, AZ (US); John Corey, Melrose, NY (US)

(73) Assignee: Comfortex Window Fashions, Watervlier, NY (US)

( * ) Notice: Subject to any disclaimer, the term of this patent is extended or adjusted under 35 U.S.C. 154(b) by 0 days.

(21) Appl. No.: 09/236,255

(22) Filed: Jan. 25, 1999

(51) Int. Cl.[7] ..... E06B 9/06
(52) U.S. Cl. ..... 160/84.05
(58) Field of Search ..... 160/84.05, 84.01, 160/84.04, 236, 84.06, DIG. 7; 428/116, 188

(56) References Cited

U.S. PATENT DOCUMENTS

| | | | | |
|---|---|---|---|---|
| Re. 30,254 | | 4/1980 | Rasmussen | 160/84 R |
| Re. 31,129 | | 1/1983 | Rasmussen | 156/193 |
| 4,262,045 | * | 4/1981 | Cheng et al. | 160/84.05 X |
| 4,288,485 | | 9/1981 | Suominen . | |
| 4,388,354 | | 6/1983 | Suominen . | |
| 4,450,027 | | 5/1984 | Colson . | |
| 4,603,072 | | 7/1986 | Colson . | |
| 4,673,600 | | 6/1987 | Anderson . | |
| 4,677,012 | | 6/1987 | Anderson . | |
| 4,685,986 | | 8/1987 | Anderson . | |
| 4,694,144 | * | 9/1987 | Delaroche et al. | 160/84.05 X |
| 4,732,630 | | 3/1988 | Schnebly . | |
| 4,861,404 | | 8/1989 | Neff . | |
| 4,884,615 | * | 12/1989 | Hsu | 160/236 |
| 4,999,073 | * | 3/1991 | Kao et al. | 160/84.05 X |
| 5,129,440 | * | 7/1992 | Colson | 160/84.05 |
| 5,184,659 | * | 2/1993 | Alcocer | 160/84.04 |
| 5,193,601 | | 3/1993 | Corey et al. . | |
| 5,228,936 | | 7/1993 | Goodhue . | |
| 5,503,210 | * | 4/1996 | Colson et al. | 160/84.05 |
| 5,680,891 | * | 10/1997 | Prince | 160/84.05 |
| 5,690,778 | | 11/1997 | Swiszcz et al. . | |
| 5,691,031 | | 11/1997 | Swiszcz et al. . | |
| 5,692,550 | | 12/1997 | Ford et al. . | |
| 5,701,940 | | 12/1997 | Ford et al. . | |
| 5,702,552 | * | 12/1997 | Kutchmarek et al. | 160/84.05 X |
| 6,019,864 | * | 2/2000 | Jones | 160/84.05 X |
| B1 4,603,072 | | 7/1991 | Colson . | |

* cited by examiner

*Primary Examiner*—David M. Purol
(74) *Attorney, Agent, or Firm*—Buchanan Ingersoll, P.C.

(57) ABSTRACT

A cellular window covering is made from multiple seamless tubular cells which are preferably extruded, cut to the desired length, stacked and glued together. The method can include extruding a plurality of tubular cells then stacking and bonding the cells together to form the fabric of the window covering. The extrusion step can include continuously extruding the tubular cell material and cutting the material at the desired length of the cells. Additional steps can include applying an adhesive to the outer surface of the cell after or sequentially with the extrusion and subsequently coating the outer surface with chopped fibers or powder after the adhesive is applied. The tubular cells can be extruded as single tubes or multiple tubes having internal ligaments which divide the extrusion into two or more connected tubular cells. Alternatively, each tubular cell can be formed from extruded half-cells which are joined together form the tubular cell. The outer surface of the tubular cells can be texturized by abrading or embossing. Additionally, fabric or thin sheets of veneer can be attached to all, or only part, of the outer surface of each tubular cell. The tubular cells can be bonded in a single row or there can be multiple rows of tubular cells bonded together to form double cell, triple cell or other configurations.

24 Claims, 6 Drawing Sheets

FIG. 8
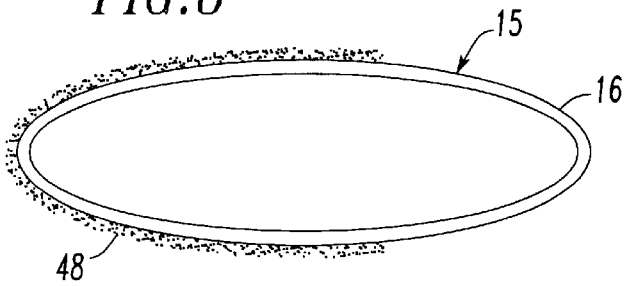
FIG. 9
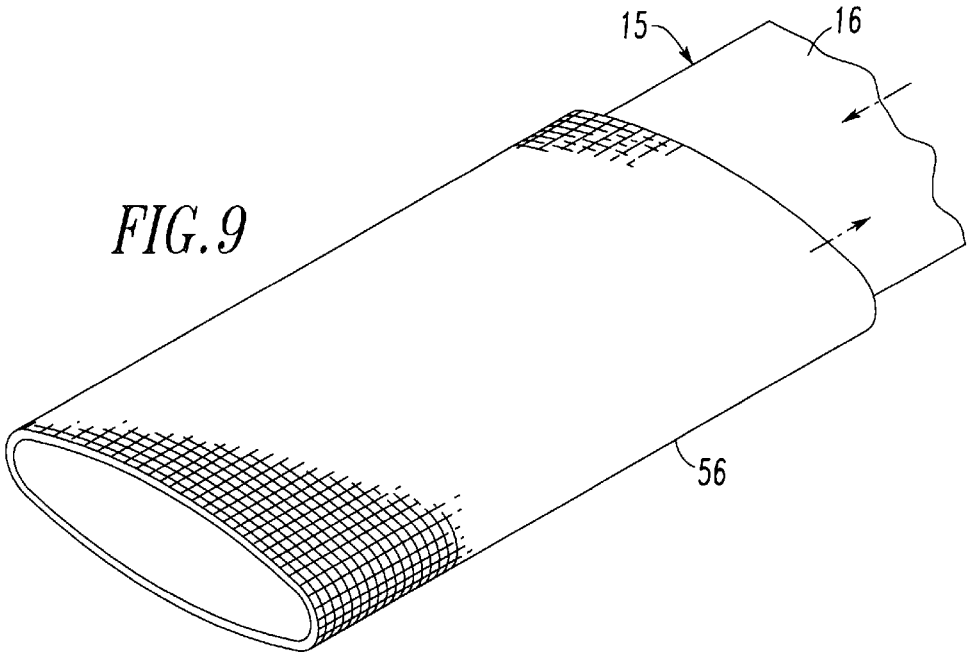
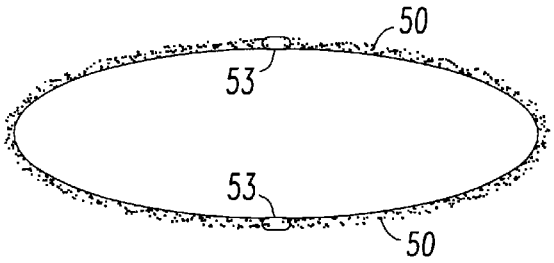
FIG. 10a
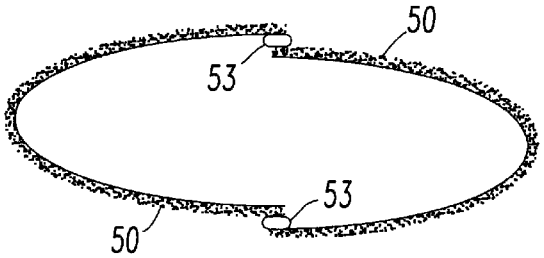
FIG. 10b

CELLULAR WINDOW COVERING HAVING SEAMLESS CELLS AND METHOD FOR MAKING SAME

BACKGROUND OF THE INVENTION

1. Field of the Invention.

The invention relates generally to cellular window coverings, and more particularly, to a cellular window covering having seamless tubular extruded cells.

2. Description of the Prior Art.

Cellular window coverings are well known in the art. Typically, cellular shading products in this field have been described and realized by beginning with flat material that is sometimes called a web. The flat material is folded and/stacked into some form then bonded along lines or seams which convert it to a cellular, collapsible sheet. This type of window covering provides energy-efficiency, beauty and ruggedness. Cellular window coverings have experienced strong sales even though they are relatively costly when compared with ordinary pleated or roller shades. They have been available mostly in non-woven fibrous materials. Non-wovens are less energy-efficient in this use than continuous fibers because of air permeability, but can be produced in many colors and textures for aesthetic appeal, resembling woven cloth which is much more costly than non-wovens. The use of fibrous material also aids in flexibility, much like stranded wire vs. solid, which is essential for collapsing/expanding multiple cells in a window covering with reasonable applied force. Film also suffers from a lack of porosity compared to fabrics, a disadvantage because porous surfaces along a bonding material form bond lines of consistent width and grip. Bonding material between two films must spread laterally and small variations in deposition typically become large variations in line width in the substrate porosity. Once bonded, smooth films must rely only on surface tension, making the bonds weaker than in porous materials where a mechanical interlock of fibers and bonding material can occur. This is especially of concern in this field, where each cell hangs from the one above (in a window) and the load on the bond is one of peeling, as opposed to tensile-normal or shearing. Peeling is the most difficult load to resist for adhesion-only joints. Notably, early developments which led to prior art type cellular window coverings began with cells formed from folded film strips. However, difficulties in bonding and aesthetic objections to the visually, and acoustically, hard film surfaces led to the adoption of the non-woven material now standard for conventional cellular window coverings.

Conventional cellular window coverings have been produced by various methods.

One type of cellular window covering is made from two flat sheets of material which are pleated and then glued face to face at the apex of the folds to form the cells. Thus created, the cellular window covering need only be cut to the desired length to match the window in which it will be installed. Some examples of this type of cellular construction are described in U.S. Pat. No. 4,861,404 to Neff and U.S. Pat. Nos. 4,673,600, 4,677,012 and 4,685,986 to Anderson.

Another type of cellular window covering is constructed by folding over the edges of flat sheets of material and gluing the free ends to form a cell, or multi-cellular structure, and then stacking and gluing the cells on top of each other to form the cellular window covering. The cells can be cut to the width of the window in which it will be installed. Some examples of this type of cellular construction are described in U.S. Pat. Nos. 5,701,940 and along alternating glue lines between sheets of material can be joined this way to form multiple honeycomb shaped rows of cells or a row of cells can be cut at a bond line if a single row of cells is desired. The cells can then be cut to the width of the window in which it will be installed. Some examples of this type of cellular construction is described in U.S. Pat. Nos. 4,388,354 and 4,288,485 to Suominen and U.S. Pat. No. 5,228,936 to Goodhue.

Another method of producing a cellular window covering is disclosed in U.S. Pat. No. 5,193,601, to Corey, et al., in which a multi-cellular collapsible window covering is made from a continuous sheet of flexible material. The sheet of flexible material is pleated in a manner to create permanent folds in the material at regular intervals in alternating directions so that the material collapses easily into a compact stack. Bonds between adjacent folds in the pleated material are formed either by welding or adhesive or other bonding agents along lines parallel to and equidistant from both sides of the pleats.

However, each of the aforementioned types of cellular window coverings are produced by methods which involve folding and gluing together flat sheets of material. A less complex and lower cost method of producing a multi-cellular collapsible window covering can be realized by producing a tubular extrusion which is cut into sections having the desired length. The extruded cells are then stacked and bonded together to create a length of joined tubular cells which forms the fabric for the window covering. Compared to conventional cellular window coverings, such an extrusion process provides all of the benefits and appearance of conventional cellular window coverings but at a lower cost, improved energy efficiency and increased variety of surface finishes. Additionally, this is done without sacrificing any of the durability or benefits of known cellular window covering constructions.

SUMMARY OF THE INVENTION

Tubular cells are produced typically by extrusion and combined to form a cellular window covering. The tubular cells can be made from, for example, a soft polyvinyl chloride or other flexible polymers which are easily extruded. In its simplest form, the cellular window covering is constructed by cutting the extruded tubular cells to the desired length then stacking and bonding the tubular cells to create a stack of joined tubular cells. The stack is attached between a headrail and a bottomrail to form the cellular window covering.

The tubular cells can be extruded as single tubes or multiple tubes having internal ligaments which divide the extrusion into two or more connected tubular cells. Additionally, the tubular cell can be formed from extruded half-cells which are joined together after extrusion to form a tube. Alternatively, the half-cells can be simultaneously extruded and joined together.

Additionally, the outer surface of the tubular cells can be texturized by one or more means of abrading, coating with adhesive and covering with fibers or powders. One or more layers of adhesive and/or chopped fibers can be applied as desired. In addition, fabric or thin sheets of veneer can be bonded over all, or only part, of the outer surface of the tubular cells. The tubular cells, single or multiple cells, or combinations thereof, can be cut to the desired length, stacked and bonded together to form the fabric of the window covering. The tubular cells can be bonded in only a single row depth or can have a depth of multiple rows of tubular cells bonded together in various configurations to form a double cell or a triple cell.

Other details, objects, and advantages of the invention will become apparent from the following detailed description and the accompanying drawings of certain embodiments thereof.

BRIEF DESCRIPTION OF THE DRAWING FIGURES

A more complete understanding of the invention can be obtained by considering the following detailed description in conjunction with the accompanying drawings, in which.

Figure 3:
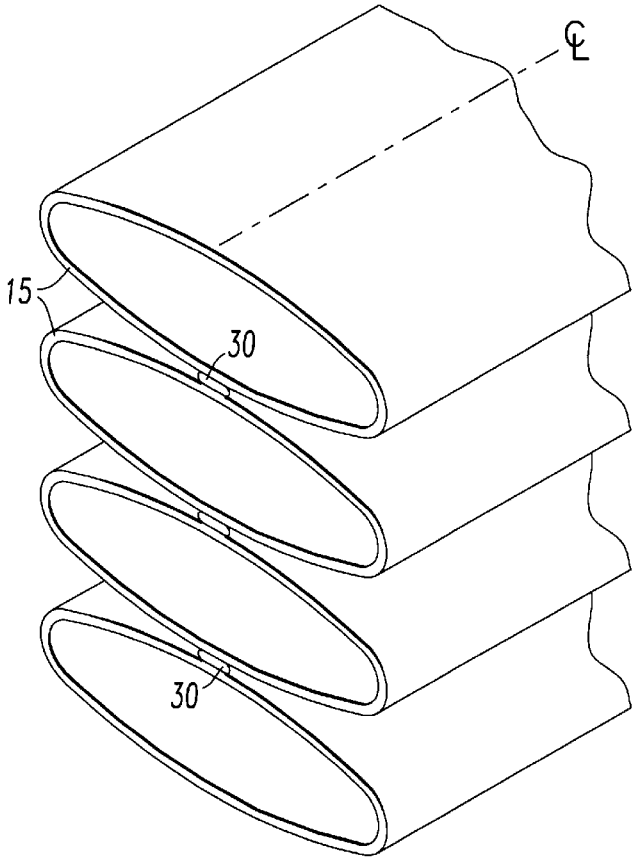
FIG. 3 is a perspective view of four of the tubular cells illustrated in FIG. 1 bonded together.
Figure 4A:
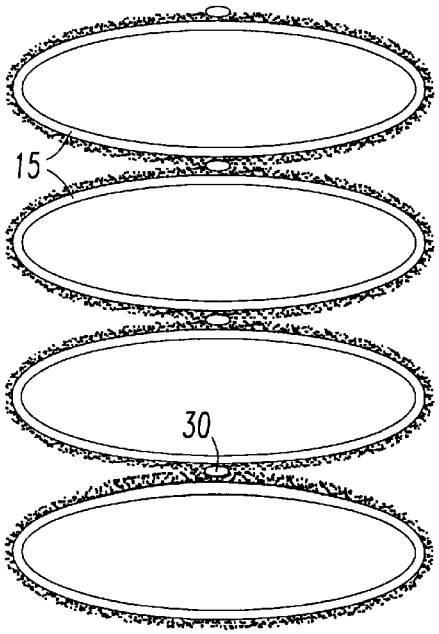

FIG. 4*a* is an end view of the bonded cells shown in FIG. 3 shown in an expanded configuration.

Figure 4B:
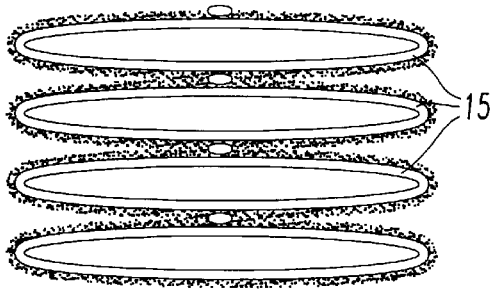

FIG. 4*b* is a side view similar to FIG. 4*a* showing the bonded tubular cells in a collapsed configuration.

Figure 5A:
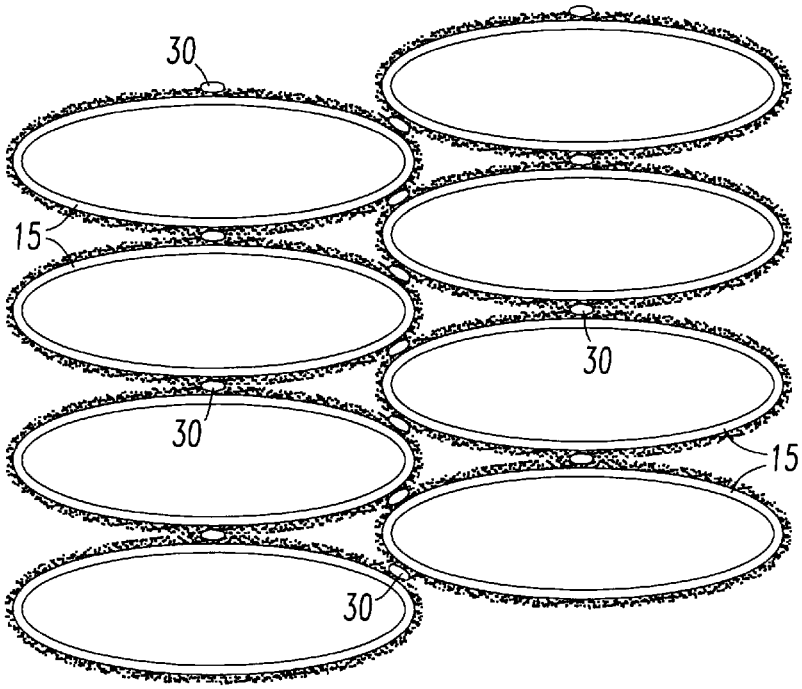

FIG. 5*a* is an end view of tubular cells bonded in a double row in an alternating fashion.

Figure 5B:
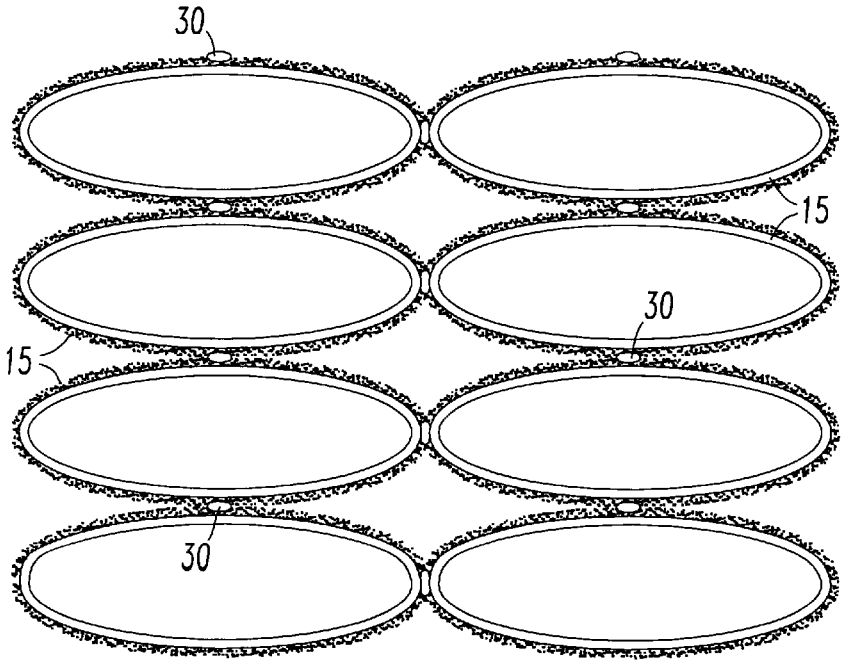

FIG. 5*b* is an end view of tubular cells bonded in a double row in an aligned side-to-side fashion.

Figure 6:
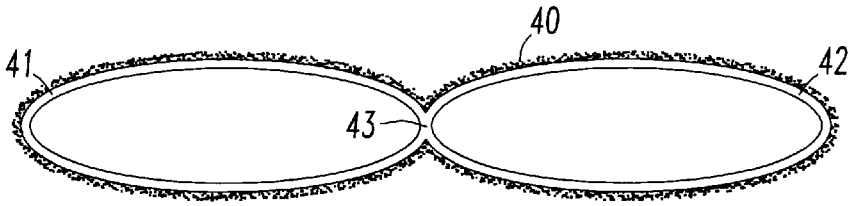

FIG. 6 is an end view illustrating a double tube extrusion having an internal ligament.

Figure 7A:
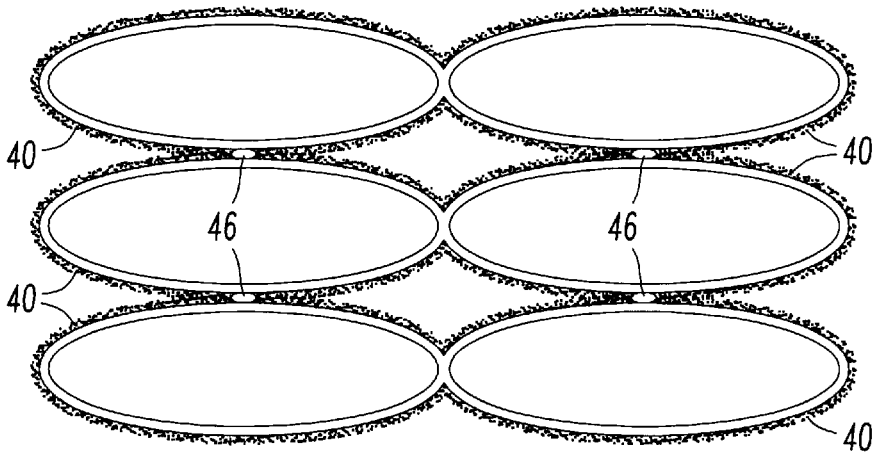

FIG. 7*a* is a end view of multiple double tube cells stacked and joined together to form a cellular window covering.

Figure 7B:
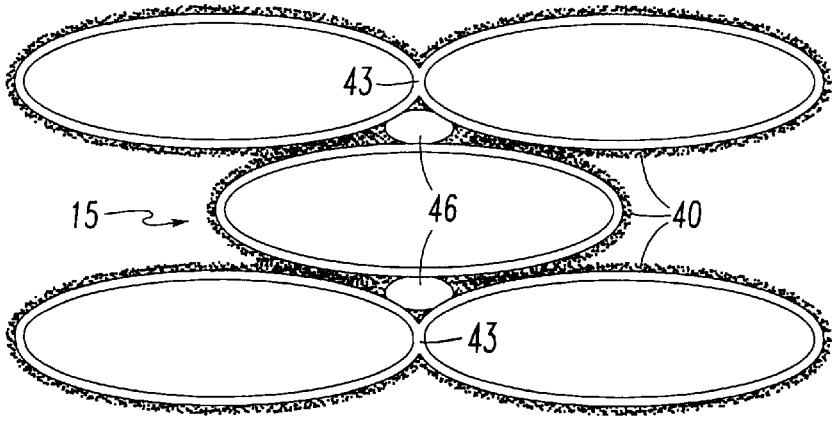

FIG. 7*b* is an end view of multiple single and double tube cells stacked and joined together to form a cellular window covering.

FIG. 8 is an end view of a extruded cell having a lamination or treatment on only one side of the cell.

FIG. 9 is a perspective view showing a tubular outer covering for an extruded tubular cell.

FIG. 10*a* is an end view of two half-cells having free ends joined in a first manner to form a tubular cell.

FIG. 10*b* is an end view of the two half-cells shown in FIG. 10*a* having the free ends joined in a different manner.

DETAILED DESCRIPTION OF THE PREFERRED EMBODIMENTS

Figure 1:
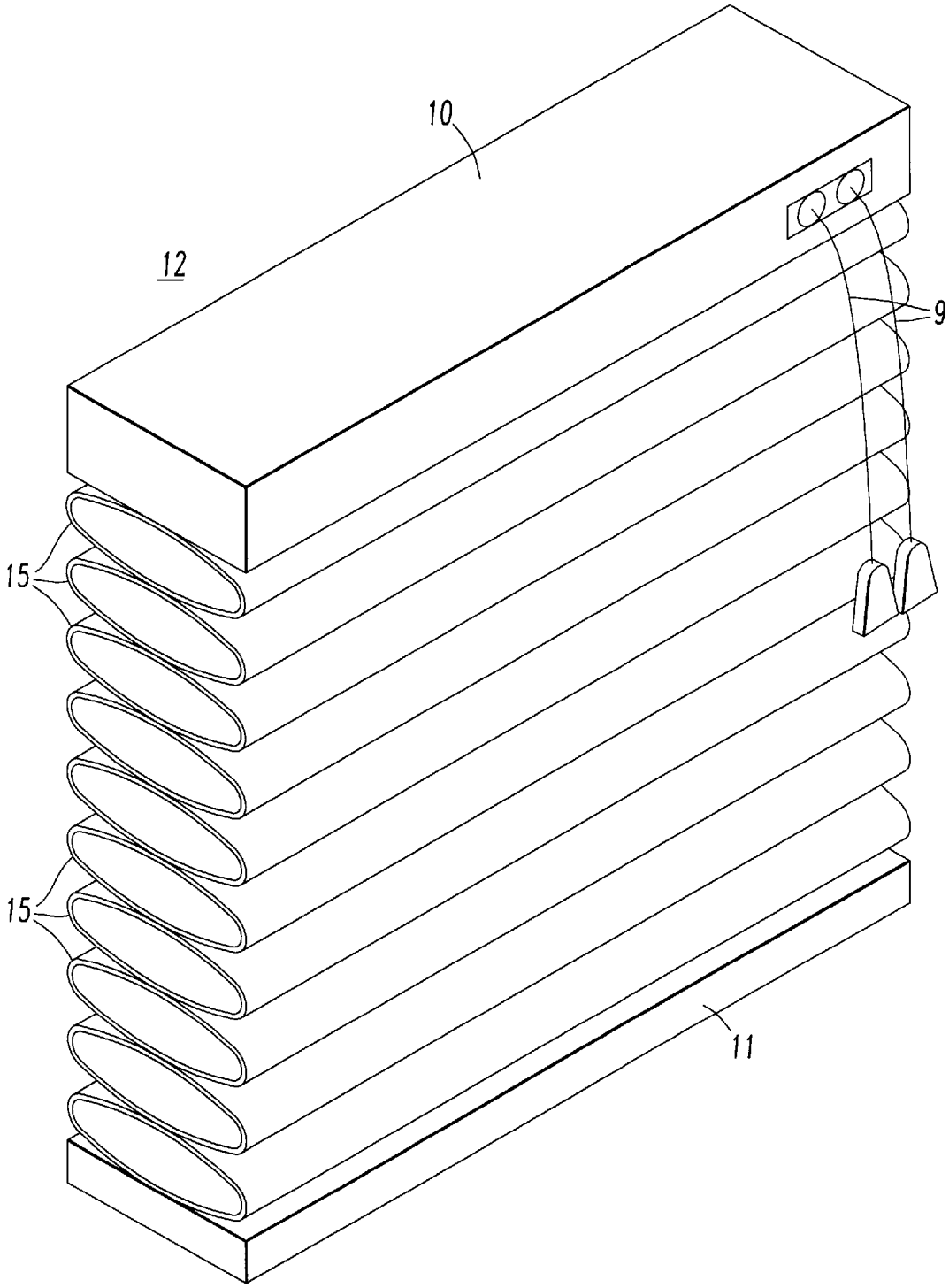
FIG. 1 is a perspective view partially in section of a cellular window covering having extruded tubular cells.

As shown in FIG. 1, we provide a cellular window covering 12 made from seamless tubular cells 15 which are provided having a desired length. The cells have no seam or bond line and preferably are made by extrusion. The tubular cells are bonded together in a stacked relationship to form the fabric of the cellular window covering 12. The stack is attached to a headrail 10 and bottomrail 11. Lift cords 9 run from the bottomrail 11 through the tubular window covering 12 and through the headrail.

Figure 2:
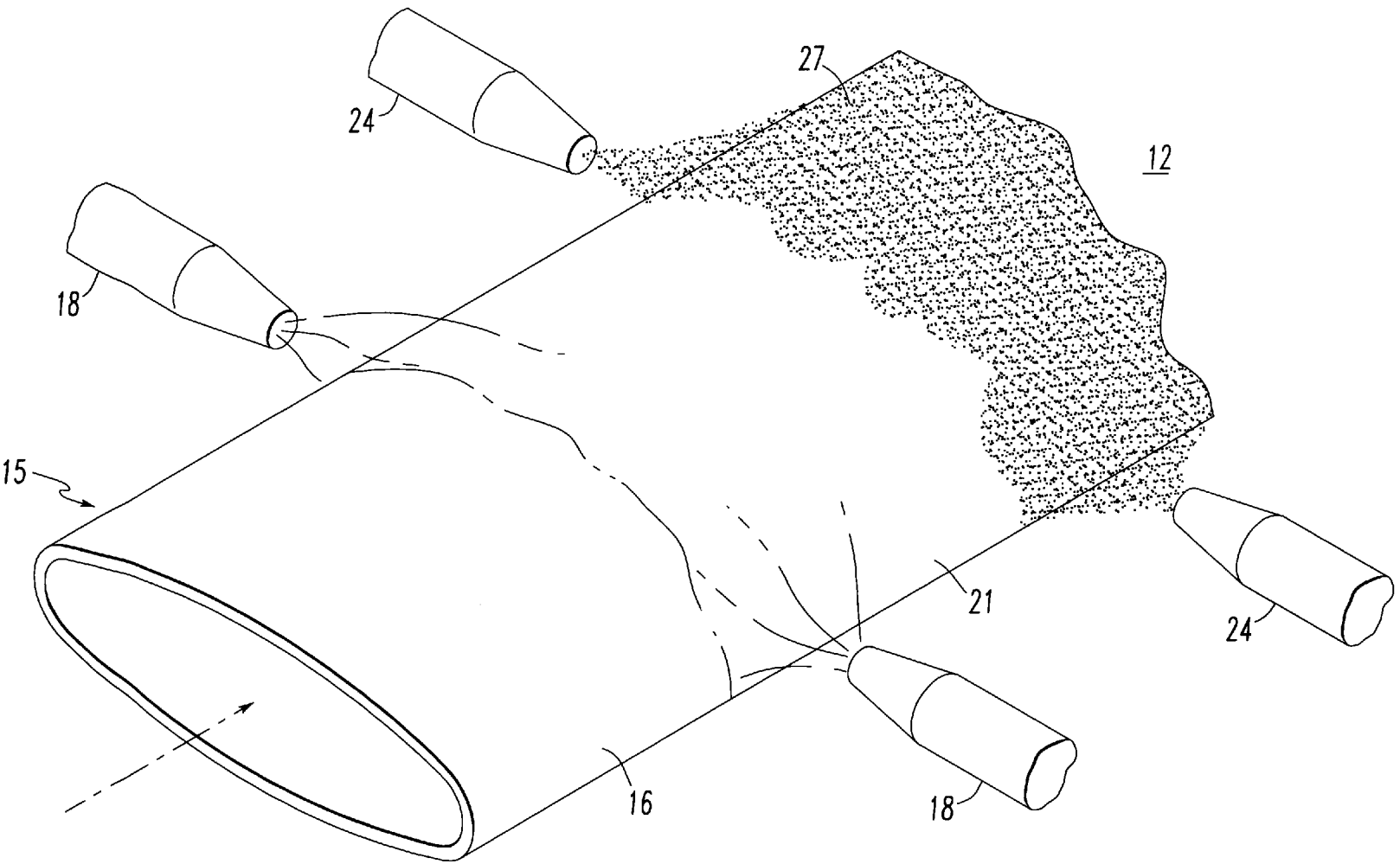
FIG. 2 is a simplified diagrammatic view of a method of extruding a tubular cell which is subsequently coated with adhesive and fibers.

An exemplary method of making such an extruded tubular cell window covering is shown in FIG. 2, wherein adhesive 21 and fibers 27 are being applied to the outer surface of the tubular cell 15 after it has been extruded through a die (not shown). In fact, the application of adhesive 21 and fibers 27 can be carried out sequentially as the tubular cell 15 is being extruded in a continuous process. According to this method, the extruded cell 15 exits the extruder in the direction shown by the arrow and the outer surface 16 is subsequently coated with adhesive 21 by applicators 18. Downstream from the adhesive applicators 18 are fiber applicators 24 which coat the tacky adhesive layered extrusion with fibers 27 in a process commonly referred to as flocking. One manner of arranging a plurality of tubular cells 15 in order to produce a window covering is shown in FIG. 3. The tubular cells 15 are cut to the desired length and then bonded one on top of another using, for example, a line of adhesive 30 disposed between adjacent surfaces of the tubular cells. Although an adhesive is described and shown in the drawings, other well-known types of bonding, such as ultrasonic welding, could also be satisfactorily employed to attach the tubular cells 15 together to form the cellular window covering. The adjacent surfaces of the cells 15 are preferably bonded at the centerline of the extrusion, $C_L$ as shown in FIG. 3, but could alternatively be bonded along a line offset from the $C_L$ to alter the expanded shape of the cellular blind. One could also use a pair of spaced apart bond lines so that the lift cords can be routed through holes punched between the two bond lines.

The tubular cells 15 can be made from, for example, soft polyvinylchloride or other flexible polymer. Tubing is easily produced directly in such materials by extrusion.

The surface of a plain extruded polymer tube can be both difficult to bond and aesthetically unacceptable to many prospective users. However, these issues can be addressed by texturizing the outer surface of the tubular cell 15 after extrusion. The preferred way to create a pleasing appearance is the flocking process shown in FIG. 2. The addition of chopped fiber can be adjusted with respect to fiber length, diameter, lay down loading, and alignment in order to simulate a number of fabrics and other surfaces, e.g. suede, flannel and velvet, which have an aesthetically pleasing character. The fibers and/or adhesive can range from transparent to opaque and may carry any colors, including metallic colors, in order to provide a wide range of effect from ice-like transparency through soft or sparkling translucence, selected darkening and even total opacity. Multiple layers of the fiber and/or adhesive could be applied to the outer surface 16 in a manner to form a pattern or several patterns having areas which vary by texture as well as by color. If desired, powders could be used in place of chopped fibers. One could also use one or more long, continuous strands of material to cover the cells.

The porosity of the adhered fibers provides a suitable bed for the application of many types of adhesives for bonding lines between the cells. The fibers control lateral spreading of bonding material when cells are brought together on the bonding lines, simplifying the control of application and producing a more uniform and smoothly functional product. The fibers also can expand the base area of the film-contact adhesive active in the cell-to-cell joint by engaging nearby and adjacent fibers. The combination of film and fiber improves the manufacturing of the bonding lines by allowing the use of stronger, more aggressive adhesives that would normally seep through the unlined non-wovens commonly used in the art. Such seepage could solidify a stack of would-be cells by bonding not just between, but within cells, resulting in irregular or prevented expansion of the cells. The film core of the tubular cell 15 acts as an impervious barrier to such bleed through of bonding materials, assuring consistent cellular expansion.

Another way to improve the appearance of the tubular cell is to emboss pattern on the outer surface. One could also laminate a fabric over the tubular cells or apply a reflective coating material.

The expanded configuration of the window covering, as for example when the window covering is fully extended, is shown in FIG. 4*a*. The compacted configuration, as when the window covering is fully retracted, is illustrated in FIG. 4*b*. The tubes can be compressed to form creases in the walls of the tubular cells 15 in order to facilitate the collapsing of each tubular cell 15 when the window covering is raised to the compacted configuration shown in FIG. 4*b*. Alternatively, if the cell walls of the tubular cell are sufficiently pliable it may not be necessary to provide such a crease.

In addition to stacking and bonding a single row of tubular cells 15 to form the cellular window covering 12, multiple rows of the stacked and bonded cells 15 can also be joined in a face-to-face relationship. In this manner, a cellular window covering can be formed having a depth of two or more tubular cells 15, a shown in FIGS. 5*a* and 5*b*. The rows of tubular cells 15 can be bonded by adhesive 30 or by another bonding method in the alternating fashion illustrated in FIG. 5*a* or in the aligned manner shown in FIG. 5*b*. It should also be understood that more than two rows can be likewise bonded to form a window covering having a depth of any number of tubular cells desired.

As an alternative to bonding together multiple rows of stacked and bonded single tube extruded cells 15, it is possible to extrude multi-cellular versions of the tubular cell 15. One example is a double celled tubular extrusion 40 as shown in FIG. 6. An internal ligament 43 is extruded with the outer cell to form two tubular cells 41 and 42. Consequently, a double cell or triple cell window covering can be constructed without necessarily having to bond together multiple rows of stacked and glued single tube cells 15. Additionally, instead of extruding the double celled tube 40 in the side-by-side configuration illustrated in FIG. 6, a double celled tube 40 could be extruded in a top-to-bottom, i.e. stacked, configuration, similarly to that shown in FIG. 3, to reduce the number of lines of adhesive needed to join a stack of tubes 15 to form the window covering 12.

The internal ligaments 43 in the double cell extrusions 40 are preferably spaced mid-way between cell bond lines so that a double cell configuration can be constructed without requiring secondary bonding in a single tube extrusion. Similarly, the spaced apart internal ligaments could be extruded to provide a triple cell structure. The double tube extruded cells 40 can be cut to length, stacked and bonded together at bond locations 46 in various configurations, such as, for example, shown in FIGS. 7*a* and 7*b*. Additionally, the double tube cell extrusion 40 can be coated with adhesive 21 and fibers 27 in the same manner described previously in connection with the embodiments of FIGS. 1 and 2.

Although certain configurations are illustrated, it is to be understood that different configurations for the cellular window covering can be produced. For example, a variety of single, double, or even triple cell extrusions can be produced and joined together in various ways, such as, for example, aligned or alternating, to form cellular window coverings having a variety of different cross-sections.

Alternatively to the flocking process described previously as being applied to the outer surface 16 of the tubular cells 15, other types of materials besides fibers may be adhered to all, or only a portion, of the outer surface 16 of the tubular cell 15. For example, a laminate 48 is shown adhered to only one side of the tubular cell 15 in FIG. 8. This laminate can be fabric or other relatively flexible material such as ultra-thin wood veneer strips, which are laminated onto one or both sides of the tubular cell as the surface treatment. Other types of suitable materials can also be utilized as the laminate 48. This type of configuration would permit treating only a portion of the outer surface 16 while leaving the opposite side, such as the backside of the window covering, untreated in order to reduce the cost of the cellular window covering.

It is not necessary to treat the outer surface 16 of the extruded cell 15 at all. Although certain problems, as described previously, can be associated with using adhesives to bond the untreated tubular cells 15 together, the outer surface 16 can be textured in other manners, such as mechanical abrasion, both for enhanced adhesion between the cells 15 and aesthetic purposes. Additionally, instead of a laminate 48, a tubular outer covering 56, as shown in FIG. 9, can be provided which is adapted to slip over and surround the outer surface 16 of the tubular cell 15. The tubular outer covering 56 can be a tube knitted from fabric. Also, the tubular outer covering 56 may be adhered to the tubular extrusion 15 using adhesive 21 in a manner similar to that described in connection with FIG. 1.

Various types of reflective coatings or other treatments for the outer surface of the tubular cells 15 can be used in conventional manners well known in the art.

Referring to FIGS. 10*a* and 10*b*, an alternative method of producing extruded tubular cells is by extruding half-cells 50 which are joined together at the free edges 51 using strips of adhesive 53. Moreover, the half-cells 50 can be co-extruded together along with the adhesive strips 53 such that they are simultaneously joined together as they are extruded to form the tubular cell. The half-cells 50 can be joined at their edges as shown in FIG. 10*a* or may be joined in the manner in which the ends overlap as shown in FIG. 10*b*. Once the half-cells 50 are joined together, they can be cut to length and glued in stacks in the same manner as the fully tubular extruded cells 15 in order to form the window covering 12. Alternatively, the half-cell extrusions can be cut to length and then joined together prior to stacking and gluing them together. One advantage of this embodiment is that the two halves can be extruded or co-extruded from different materials or in different colors. Another way to produce seamless tubes is by knitting. Such a tube would look like outer tubular covering 56 in FIG. 9. However, the window covering would be made only of knitted tubes without an internal extruded tube like tube 15 in FIG. 9.

Although certain embodiments of the invention have been described in detail, it will be appreciated by those skilled in the art that various modifications to those details could be developed in light of the overall teaching of the disclosure. Accordingly, the particular embodiments disclosed herein are intended to be illustrative only and not limiting to the scope of the invention which should be awarded the full breadth of the following claims and any and all embodiments thereof.

We claim:

1. A cellular window covering comprising a plurality of nonwoven seamless tubular cells that are sufficiently pliable to collapse and are formed devoid of creases or hinges, each cell having an upper surface and a lower surface, at least one of said upper and lower surfaces of each of said plurality of seamless tubular cells joined to one of said upper and lower surfaces of an adjacent cell to create a stack of seamless tubular cells which forms the cellular window covering.

2. The cellular window covering of claim 1 wherein the tubular cells are made by extrusion.

3. The cellular window covering of claim 1 wherein said upper and lower surfaces of said adjacent cells are joined by an adhesive.

4. The cellular window covering of claim 1 further comprising said stack of cells being a plurality of rows of cells each joined in a front-to-back relationship to form a multi-cellular cellular window covering.

5. The cellular window covering of claim 4 wherein the rows of cells form one of a double cell structure and a triple cell structure.

6. The cellular window covering of claim 1 further comprising:

a. an adhesive coating provided on at least a portion of an outer surface of each cell; and b. fibers applied on said adhesive.

7. The cellular window covering of claim 6 wherein at least a portion of said outer surface is abraded before said adhesive is applied.

8. The cellular window covering of claim 6 wherein multiple applications of at least one of said adhesive and said fibers are applied.

9. The cellular window covering of claim 1 further comprising a tubular outer covering provided over an outer surface of said cell.

10. The cellular window covering of claim 9 wherein said tubular outer covering is a woven or knitted material.

11. The cellular window covering of claim 9 also comprising an adhesive provided on at least a portion of said outer surface which bonds said tubular outer covering over said outer surface.

12. The cellular window covering of claim 1 further comprising a laminate attached to at least a portion of said outer surface.

13. The cellular window covering of claim 12 wherein said laminate is formed from one of fabric and wood veneer.

14. The cellular window covering of claim 1 wherein each tubular cell comprises at least two tubular cells joined by an internal ligament.

15. The cellular window covering of claim 1 further comprising a tubular outer covering provided over an outer surface of said cell.

16. The cellular window covering of claim 15 wherein said tubular outer covering is a woven or knitted material.

17. The cellular window covering of claim 15 also comprising an adhesive provided on at least a portion of said outer surface which bonds said tubular outer covering over said outer surface.

18. A cellular window covering comprising a plurality of extruded seamless cells that are sufficiently pliable to collapse and are formed devoid of creases or hinges, bonded together by an adhesive to create a stack of extruded cells which forms the cellular window covering wherein each of said plurality of cells has at least one bonding surface bonded to a bonding surface of an adjacent cell by the adhesive and at least a portion of each bonding surface is abraded.

19. The cellular window covering of claim 18 also comprising fibers on the bonding surfaces of the plurality of cells.

20. The cellular window covering of claim 18 further comprising:

a. an adhesive coating provided on at least a portion of an outer surface of each cell; and b. fibers applied on said adhesive.

21. The cellular window covering of claim 20 wherein multiple applications of at least one of said adhesive and said fibers are applied.

22. The cellular window covering of claim 18 further comprising a laminate attached to at least a portion of said outer surface.

23. The cellular window covering of claim 1 wherein said laminate is formed from one of fabric and wood veneer.

24. The cellular window covering of claim 18 wherein each tubular cell comprises at least two tubular cells joined by an internal ligament.

* * * * *